US005849984A

United States Patent [19]

Kim et al.

[11] Patent Number: 5,849,984

[45] Date of Patent: Dec. 15, 1998

[54] METHOD AND SYSTEM FOR TREATING WASTE NITROCELLULOSE

[75] Inventors: Byung J. Kim, Champaign, Ill.; Hsin-Neng Hsieh, East Brunswick; Fong-Jung Tai, Livingston, both of N.J.

[73] Assignee: The United States of America as represented by the Secretary of the Army, Washington, D.C.

[21] Appl. No.: 856,453

[22] Filed: May 14, 1997

[51] Int. Cl.[6] ..... A62D 3/00

[52] U.S. Cl. ..... 588/203; 588/204; 149/124; 204/530; 204/531; 204/632; 435/161; 435/162; 435/165

[58] Field of Search ..... 588/202, 204, 588/203; 149/124; 204/530, 531, 632; 435/161, 162, 165

[56] References Cited

U.S. PATENT DOCUMENTS

| | | | |
|---|---|---|---|
| 4,612,286 | 9/1986 | Sherman et al. | 435/157 |
| 4,650,689 | 3/1987 | Hedrick | 426/600 |
| 5,244,553 | 9/1993 | Goldstein | 204/182.4 |
| 5,562,777 | 10/1996 | Farone et al. | 127/37 |

*Primary Examiner*—Ngoclan Mai
*Attorney, Agent, or Firm*—Luther A. Marsh

[57] ABSTRACT

A method for treating waste nitrocellulose, the method comprising the steps of treating nitrocellulose with acid in a hydrolysis process to break the nitrocellulose down to glucose, recovering a majority of the acid by electrodialysis, neutralizing a remainder of the acid, and fermenting the glucose to convert the glucose to a useful product. The invention further comprises a system for performing the above method.

25 Claims, 1 Drawing Sheet

METHOD AND SYSTEM FOR TREATING WASTE NITROCELLULOSE

BACKGROUND OF THE INVENTION (1) Field of the Invention

The invention relates to disposition of waste nitrocellulose and is directed more particularly to the treatment of nitrocellulose to convert the nitrocellulose to a useful product.

(2) Description of the Prior Art

Nitrocellulose, also known as cellulose nitrate, is a cotton or pulp-like material, used in explosives and solid rocket propellants, among other things. Waste nitrocellulose has been disposed of by ammunition plants and rocket fuel producers by open burning and/or open detonation. However, it is known that such burning and detonation is to be prohibited for environmental reasons. Accordingly, there exists an urgent need for alternatives to burning and detonation of waste nitrocellulose.

SUMMARY OF THE INVENTION

It is, therefore, an object of the invention to provide a method and system for treating waste nitrocellulose so as to obviate the need for burning or detonation thereof.

A further object of the invention is to provide such a method and system as can be used to convert the waste nitrocellulose to a useful product.

A still further object of the invention is to provide such a process utilizing a closed system to prevent propagation of toxic or explosive fumes into the atmosphere.

With the above and other objects in view, as will hereinafter appear, a feature of the present invention is the provision of a method for treating waste nitrocellulose, the method comprising the steps of treating nitrocellulose with acid in a hydrolysis process to break the nitrocellulose down to glucose, recovering a majority of the acid by electrodialysis, neutralizing a remainder of the acid, and fermenting the glucose to convert the glucose to a useful product.

In accordance with a further feature of the invention, there is provided a system for treating nitrocellulose, the system comprising a reactor for receiving nitrocellulose, acid, and acid gas for performing a hydrolysis operation to convert a major portion of the nitrocellulose to glucose, and for discharging glucose and acid solution. A stripper is provided for removing acid gas from the solution and discharging the removed acid gas, the stripper being adapted to outflow glucose and acid solution. A centrifuge receives the glucose and acid solution flowed from the stripper, and receives water, and outflows residue, glucose, and acid solution. An electrodialysis unit is provided for receiving the glucose and acid solution flowed from the centrifuge, for performing an electrodialysis operation thereon, and for outflowing from a first outlet an acid solution and from a second outlet a glucose and dilute acid solution. An acid absorber receives the acid gas from the stripper and the acid solution from the electrodialysis unit. A neutralization unit is provided for receiving the glucose and dilute acid solution outflowed from the electrodialysis unit, for receiving a base, for neutralizing acid remaining in the dilute acid solution, and for outflowing glucose.

The above and other features of the invention, including various novel details of construction and combinations of steps, will now be more particularly described with reference to the accompanying drawings and pointed out in the claims. It will be understood that the particular method and system embodying the invention are shown by way of illustration only and not as limitations of the invention. The principles and features of this invention may be employed in various and numerous embodiments without departing from the scope of the invention.

BRIEF DESCRIPTION OF THE DRAWING

Reference is made to the accompanying drawing in which is shown an illustrative embodiment of the invention, from which its novel features and advantages will be apparent.

In the drawing is shown one form of method and system illustrative of an embodiment of the invention.

DESCRIPTION OF THE PREFERRED EMBODIMENT

Figure 1:
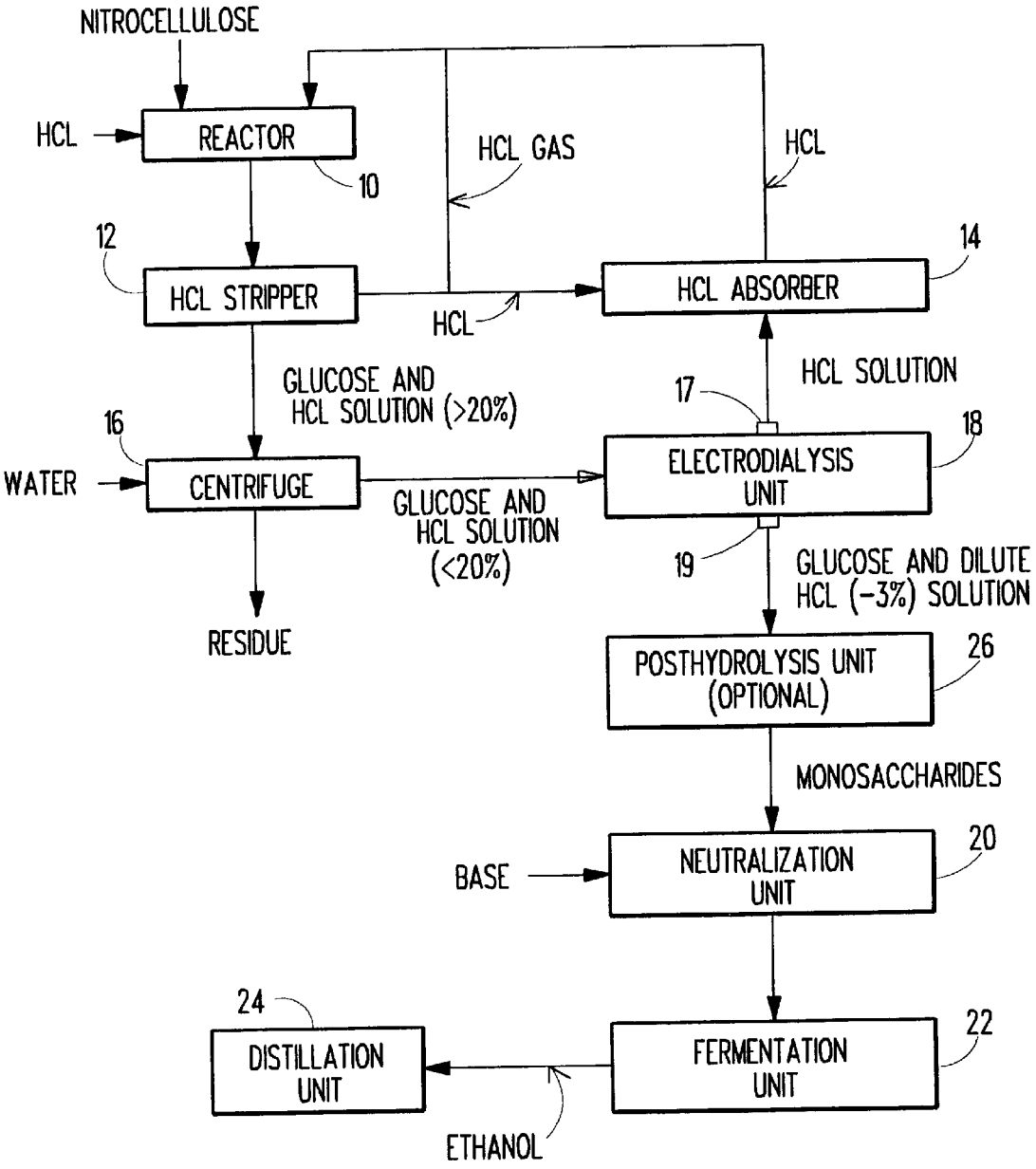

Referring to the drawing, it will be seen that waste nitrocellulose to be treated and converted into a useful product, such as ethanol, is placed in a reactor 10, i.e., a container or tank in which a chemical or biological reaction takes place. Hydrochloric acid (HCl) from an outside source is also added to the reactor 10, wherein a hydrolysis process converts a majority (typically, in excess of 60%) of the nitrocellulose to glucose, or sugar oligomers. The HCl is of a selected concentration and the hydrolysis process is undertaken at a selected ratio of HCl to nitrocellulose. At 90° C., the hydrolysis reaction requires about nine minutes to reach maximum glucose yield of about 85%, by weight, of the nitrocellulose in the reactor. At 60° C., the hydrolysis reaction requires about 63 minutes to reach maximum glucose yield (85%). The temperature preferably is 50°–90° C. and affects only the rate of reaction, not the maximum glucose yield.

Acid concentrations of 19%–38% have been utilized. Tests have shown that the reactions are faster at higher acid concentrations. The effect on hydrolysis of various ratios of acid to nitrocellulose has also been investigated, including ratios of about 5-1 to 30-1. The results have indicated that the higher the ratio, the faster the degradation of nitrocellulose. Preferably, hydrolysis is conducted with an acid concentration of greater than 20% and a temperature of about 60° C. The ratio of acid to nitrocellulose affects the rate of degration, but not the glucose yield.

The hydrolyzate, including the glucose converted from nitrocellulose and substantially all of the HCl admitted to the reactor 10, is flowed into an HCl stripper 12. It is necessary to separate the HCl from the glucose to (1) permit fermentation of the glucose, and (2) reduce processing costs by recovering and recycling the acid. To this end, the stripper 12, by application of high temperatures, vaporizes HCl and separates HCl gas from the hydrolyzate at reduced pressure. The HCl gas is returned to the reactor 10. A portion of the HCl not vaporized is conveyed to a hydrochloric acid absorber 14.

The hydrolyzate solution leaving the stripper 12, which includes greater than 20% HCl, is flowed into a centrifuge 16, along with pure water. Operation of the centrifuge 16 produces (1) a hydrolyzate including water, glucose and less than 20%, by weight, of HCl, and (2) a residue which is removed from the system. The residue comprises the solid portion of the glucose, HCl, and nitrocellulose, if any.

The hydrolyzate leaving the centrifuge 16 is flowed into an electrodialysis unit 18 wherein a membrane system (not shown) is utilized to separate the major portion of the remaining HCl from the glucose. Two membrane systems found suitable both include a membrane stack procured from Ionics Co., containing (1) twenty type 103-QZL-386 anion-exchange membranes, and (2) twenty type 61-CZL-386 cation-exchange membranes. The prior removal of residue from the hydrolyzate protects the electrodialysis membranes from clogging.

The HCl separated from the hydrolyzate in the electrodialysis unit 18 is flowed from a first outlet 17 to the absorber 14, and thence, to the reactor 10. Once HCl is recovered from the system, HCl from the outside source is admitted to the reactor only when the amount of HCl recovered from the system is insufficient for hydrolysis operation.

The remaining hydrolyzate is flowed from the electrodialysis unit 18 from a second outlet 19 to a neutralization unit 20, wherein a base is introduced to neutralize the acid remaining in the hydrolyzate. At this point in the process, the HCl accounts for only about 3% of the weight of the acid and water in the hydrolyzate. Inasmuch as most microorganisms can only survive in favorable conditions, and inasmuch as the pH is low because of the addition of HCl, a neutralization process is undertaken to raise the pH of the hydrolyzate before fermentation.

Assuming ethanol to be the desired useful end product, the hydrolyzate, with substantially no active HCl remaining therein, is flowed into a fermentation unit 22 for conversion of the glucose to ethanol by microorganisms. Found particularly suited to the task are saccharomyces which are efficient in converting sugars to ethanol and are not as strongly inhibited by high ethanol concentrations as are other microbes.

After conversion, the ethanol may be flowed to an appropriate distillation unit 24 for further purification and refinement of the ethanol.

If desired, the hydrolyzate leaving the electrodialysis unit 18 may be flowed to a posthydrolysis unit 26 for a post hydrolysis operation prior to being flowed to the neutralization unit 20. Hydrolysis is a process to break large molecules down to small molecules. Such breakdown is necessary inasmuch as microorganisms cannot utilize large molecule compounds or nutrients in the fermentation step. Hydrolysis can be performed through a chemical process, as described above. The inclusion of a post-hydrolysis depends upon what is in the hydrolyzate solution. If only sugar (glucose or monosaccharide) exists, there is no need for post-hydrolysis. However, if large molecules are present, as in polysaccharides, post hydrolsis preferably is undertaken. In the embodiment illustrated, the posthydrolysis unit produces monosaccharides which are flowed to the neutralization unit 20.

There is thus provided a safe method and system for treating nitrocellulose waste in a closed system, obviating the need to burn or detonate the nitrocellulose, and providing a useful end product, such as glucose and/or ethanol, or the like.

It is to be understood that the present invention is by no means limited to the particular steps and constructions herein disclosed and/or shown in the drawings, but also comprises any modifications or equivalents within the scope of the claims. For example, rather than fermenting the solution after neutralization, to obtain ethanol, the output from the neutralization unit may be used for wastewater treatment. Alternatively, the neutralization unit output may be directed to the fermentation unit, as shown in FIG. 1, to produce ethanol, which may be used in wastewater treatment without distillation.

What is claimed is:

1. A method for treating waste nitrocellulose, the method comprising the steps of:

treating nitrocellulose with acid in a hydrolysis process to break the nitrocellulose down to glucose, wherein said hydrolysis process is carried out at from about 60° C. to about 90° for from about nine minutes to about 63 minutes to provide a yield of said glucose of about 85%, by weight, of said nitrocellulose;

recovering a majority of the acid by electrodialysis;

neutralizing a remainder of the acid; and fermenting the glucose to convert the glucose to a useful product.

2. The method in accordance with claim 1 wherein said acid is hydrochloric acid.

3. The method in accordance with claim 2 wherein recovery of said hydrochloric acid includes the steps of flowing a hydrolyzate comprising said glucose broken down from said nitrocellulose and said hydrochloric acid through a stripper device wherein hydrochloric acid gas is separated from said hydrolyzate; flowing said hydrolyzate, less said hydrochloric acid gas, to a centrifuge, operating said centrifuge, removing residue from said centrifuge, and flowing said hydrolyzate, less said residue, to an electrodialysis unit, and operating said electrodialysis unit to separate said majority of said hydrochloric acid from said glucose.

4. The method in accordance with claim 3 wherein said neutralizing of said remainder of said hydrochloric acid is undertaken by adding a base to said hydrolyzate leaving said electrodialysis unit.

5. The method in accordance with claim 4 wherein said useful product comprises ethanol.

6. The method in accordance with claim 5 including the additional step of distillation of said ethanol.

7. The method in accordance with claim 4 wherein after separating said majority of said hydrochloric acid from said glucose and before said neutralization of said remainder of said hydrochloric acid, said hydrolyzate is subjected to a post hydrolysis operation to produce monosaccharide, which is followed by said neutralization.

8. A method for treating waste nitrocellulose, the method comprising the steps of:

introducing waste nitrocellulose into a reactor;

introducing hydrochloric acid into the reactor;

treating the nitrocellulose in the reactor by acid hydrolysis to convert a majority of the nitrocellulose to glucose;

flowing a hydrolyzate solution from the reactor, the solution containing the glucose converted from nitrocellulose and substantially all the hydrochloric acid introduced into the reactor, and flowing the hydrolyzate solution into a hydrochloric acid gas stripper wherein hydrochloric acid gas is separated from the hydrolyzate and returned to the reactor and a portion of the hydrochloric acid is flowed to a hydrochloric acid absorber;

flowing the hydrolyzate solution, including the glucose and over 20%, by weight, of hydrochloric acid, from the hydrochloric acid gas stripper to a centrifuge;

flowing pure water into the centrifuge;

operating the centrifuge to provide, and discharging therefrom, the hydrolyzate solution including the glucose and less than 20%, by weight, hydrochloric acid, and further discharging residue therefrom, and flowing the hydrolyzate solution, including water, into an electrodialysis unit;

operating a membrane system in the electrodialysis unit to separate hydrochloric acid from the hydrolyzate solution, the separated hydrochloric acid being about 20%, by weight, of the hydrolyzate solution;

flowing the separated hydrochloric acid from the electrodialysis unit to the absorber;

flowing the hydrochloric acid in the absorber and the hydrochloric acid gas from the stripper in the absorber to the reactor for re-use; and flowing the hydrolyzate, including the glucose, water, and about 3%, by weight of glucose and water, of hydrochloric acid to a neutralization unit wherein a base is introduced to neutralize the hydrochloric acid.

9. The method in accordance with claim 8 including the additional step of flowing the hydrolyzate into a fermentation unit for conversion of the glucose into ethanol.

10. The method in accordance with claim 8 wherein said hydrolysis is carried out at about 90° C. for about nine minutes to convert about 85%, by weight, of the nitrocellulose to glucose.

11. The method in accordance with claim 8 wherein said hydrolysis is carried out at about 60° C. for about 63 minutes to convert about 85%, by weight, of the nitrocellulose to glucose.

12. The method in accordance with claim 8 wherein said hydrolysis converts more than 60% of the nitrocellulose to glucose.

13. The method in accordance with claim 12 wherein said hydrolysis converts about 85% of the nitrocellulose to glucose.

14. The method in accordance with claim 9 wherein fermentation in said fermentation unit is facilitated by microbes.

15. The method in accordance with claim 14 wherein said microbes comprise saccharomyces.

16. The method in accordance with claim 8 wherein said membrane system comprises a selected one of a group consisting of anion-exchange membranes and cation-exchange membranes.

17. The method in accordance with claim 8 wherein after separation of said hydrochloric acid from said hydrolyzate solution in said electrodialysis unit, said glucose and said about 3% of hydrochloric acid is subjected to posthydrolysis before said neutralization.

18. The method in accordance with claim 9 including the additional step of flowing the ethanol to a distillation unit and undertaking distillation of said ethanol.

19. The method in accordance with claim 17 wherein said posthydrolysis step provides monosaccharides which are flowed to said neutralization unit, along with the remaining HCl solution.

20. The method in accordance with claim 8 wherein said hydrochloric acid introduced into the reactor is of a concentration of greater than 20%.

21. The method in accordance with claim 20 wherein the hydrolysis is undertaken at about 60° C.

22. A system for treating nitrocellulose, the system comprising:

a reactor for receiving nitrocellulose, acid, and acid gas, for performing a hydrolysis operation to convert a major portion of the nitrocellulose to glucose, and for discharging a glucose and acid solution;

a stripper for removing acid gas from the solution and discharging the removed acid gas, and adapted to outflow glucose and acid solution;

a centrifuge for receiving the glucose and acid solution flowed from said stripper, for receiving water, for outflowing residue, and for outflowing glucose and acid solution;

an electrodialysis unit for receiving the glucose and acid solution flowed from said centrifuge, for performing an electrodialysis operation thereon, and for outflowing from a first outlet an acid solution and from a second outlet a glucose and dilute acid solution;

an acid absorber for receiving acid from the stripper and the acid solution from the electrodialysis unit;

a neutralization unit for receiving the glucose and dilute acid solution outflowed from the electrodialysis unit, for receiving a base, for neutralizing acid remaining in the dilute acid solution, and for outflowing glucose.

23. The system in accordance with claim 22 further comprising a posthydrolysis unit for receiving the glucose and dilute acid solution from said electrodialysis unit, for performing a hydrolysis operation, and for outflowing monosaccharide produced by the hydrolysis operation, to said neutralization unit.

24. The system in accordance with claim 22 further comprising a fermentation unit for receiving glucose from said neutralization unit, for fermenting the received glucose, and for outflowing ethanol.

25. The system in accordance with claim 24 further comprising a distillation unit for receiving the ethanol from the fermentation unit, and for distilling the ethanol.

* * * * *